United States Patent [19]

McConnell

[11] Patent Number: 4,790,716

[45] Date of Patent: Dec. 13, 1988

[54] DEVICE FOR HANDLING A WHEELCHAIR

[76] Inventor: Sylvia J. McConnell, P.O. Box 4048, Opelika, Ala. 36801

[21] Appl. No.: 32,769

[22] Filed: Mar. 31, 1987

Related U.S. Application Data

[63] Continuation-in-part of Ser. No. 869,983, Jun. 3, 1986, Pat. No. 4,726,730.

[51] Int. Cl.[4] ..... A61G 7/10

[52] U.S. Cl. ..... 414/678; 254/9 C; 414/921

[58] Field of Search ..... 254/3 R, 3 B, 122, 3 C, 254/126, 9 R, 9 B, 9 C, 7 R, 7 B, 7 C; 269/323; 297/DIG. 4; 410/51; 414/495, 678, 754, 778, 921

[56] References Cited

U.S. PATENT DOCUMENTS

| | | | |
|---|---|---|---|
| 3,476,404 | 11/1969 | Rachman | 297/DIG. 4 X |
| 3,888,463 | 6/1975 | O'Brien et al. | 414/921 X |
| 4,192,549 | 3/1980 | Petersen | 414/678 X |
| 4,492,403 | 1/1985 | Blomgren et al. | 410/51 X |
| 4,592,695 | 6/1986 | McConnell | 414/680 X |

FOREIGN PATENT DOCUMENTS

| | | | |
|---|---|---|---|
| 2509281 | 1/1983 | France | 254/7 C |

*Primary Examiner*—Robert J. Spar
*Assistant Examiner*—Janice Krizek
*Attorney, Agent, or Firm*—George J. Porter

[57] ABSTRACT

FIGS. 1–5 show a device (10) for selectively lifting and tilting a wheelchair (14) and its occupant to a convenient position for performance of a service, such as a dental work or beauty salon work, upon the occupant of the wheelchair. An alternative embodiment of the invention is wheelchair handling device (110), which is disclosed in FIGS. 6–10, inclusive. Device (110) comprises housing (102), wheelchair receptacle (104), backrest (106), wheels (108 and 113), foot-operated control box (112) having dual footpad switch (114) for raising and lowering housing (102) and dual footpad switch (116) for tilting the receptacle (104) forward and backward. Switch (114) operates motor-driven lift system (118), which comprises a pair of scissors jacks (136) and vertical worm gears (134 and 135) driven by a chain (126) and reversible motor (122). Switch (116) operates motor-driven tilting system (142), which comprises a reversible electric motor (146) driving a worm gear (148) and a worm gear follower (150) pivotally attached to wheelchair receptacle (104). Accessories include wash basin (154) and wash basin bracket (152) with support (151) adjustably attached to backrest frame (127).

13 Claims, 10 Drawing Sheets

DEVICE FOR HANDLING A WHEELCHAIR

CROSS REFERENCE TO RELATED APPLICATIONS

This application is a continuation-in-part of the co-pending application of Sylvia J. McConnell, Ser. No. 869,983, filed June 3, 1986, now U.S. Pat. No. 4,726,730, which was co-pending with U.S. Patent application Ser. No. 662,578, filed Oct. 19, 1984, now U.S. Pat. No. 4,592,695, dated June 3, 1986.

TECHNICAL FIELD

The present invention relates to a device for handling a wheelchair and its occupant and more particularly to a device which is capable of securely holding the wheelchair while lifting and tilting it to a convenient position for performance of a service to the occupant. For example, the device is particularly suitable for positioning a wheelchair occupant for convenient rendering of services such as those performed in a dental office or a beauty salon.

BACKGROUND OF THE INVENTION

It has long been a serious problem to conveniently position those confined to wheelchairs for receiving services to their person such as would be performed by a beauty operator, a dentist, or other services which may require the occupant of the wheelchair to be raised, lowered, or tilted in order to effectively perform the intended service. Prior to the advent of wheelchair handling devices, it was necessary to move the occupant of the wheelchair physically by lifting the person to a special positioning chair in order to receive services such as a hair shampoo or dental work. In many cases movement of persons confined to wheelchairs can be quite dangerous in that the injury or impairment which causes confinement to the wheelchair may be seriously aggravated.

As mentioned in my earlier copending patent application (U.S. Pat. No. 4,592,695 dated June 3, 1986) several prior art patents are of interest because they relate to the above-mentioned problems. Of these, U.S. Pat. No. 4,227,740 to EAST shows a simple attachment for a wheelchair which allows a wheelchair to be tilted backward so that the occupant can rest or sleep. However, this structure is somewhat light and flimsy and does not instill confidence in the occupant of the wheelchair. Moreover, this device does not have sufficient versatility to accomplish the objects of this invention since it cannot be raised and it may be tilted backward to only one angle, which is about 55 degrees from the vertical. This is not sufficient for the purpose of performing the necessary services to the wheelchair occupant. For maximum convenience in performance of such services the occupant must really be tilted backward about 80 degrees or more. It is also apparent that the device of EAST does not substantially support the wheelchair in the forward direction. Obviously, if one were to lean forward in such a chair, it would tilt forward very quickly, resulting in possible injury to the occupant. It is also readily apparent that this device does not provide the feature which enables lifting the wheelchair to a height which is convenient for performance of the services needed. It is further obvious that this device requires modification to the wheelchair and that it is not intended for universal use with a standard wheelchair.

A second prior art patent of interest is U.S. Pat. No. 4,158,524 to SERAFIN. This patent shows a platform for raising a wheelchair from ground level to a higher level, such as a porch. This patent does not contemplate and does not show any structure for securely holding the wheelchair on the platform and tilting the platform through an angle of 45 degrees to 90 degrees as does the present invention.

U.S. Pat. No. 4,024,960 to FORSTER shows a large tilting platform for raising one end of a truck or car. However, this platform is considerably larger than would be necessary to hold a wheelchair. Moreover, this patented invention does not contemplate securing anything to the platform while it is being raised and of course does not provide any structure for securing or tilting a wheelchair.

None of the known prior art patents mentioned above contemplate raising and tilting a wheelchair on a platform and securing the wheelchair securely to the platform in order to tilt it through an angle of 45 degrees to 90 degrees for purposes of performing a service to the occupant of a wheelchair.

Therefore, it is an object of this invention to provide a lifting and tilting platform with a means attached to the platform for securely holding a wheelchair on the platform, for performing a service to the occupant of a wheelchair without the occupant having to leave his/her wheelchair.

It is another object of this invention to provide a wheelchair handling device which can lift a wheelchair and tilt it backwards through an angle of 45 degrees to 90 degrees, for performing a service to the occupant of a wheelchair.

It is a further object of this invention to provide a lifting and tilting platform for a wheelchair, the platform having a motor-driven mechanism to operate the device.

It is yet another object of this invention to provide a lifting and tilting platform for a wheelchair, the platform being arranged to be simply and quickly operated by the use of convenient hand or foot controls.

It is a still further object of this invention to provide a safe and efficient wheelchair handling device, requiring only one operator, for securely holding a wheelchair and lifting and tilting the wheelchair backwards in order to perform a service to the occupant of a wheelchair.

SUMMARY OF THE INVENTION

The present invention is a lifting and tilting device for persons confined to a wheelchair. It is capable of securely holding a wheelchair on its platform and of lifting and tilting the wheelchair and its occupant. Thus the device functions to position the occupant for convenient access by a person performing a service such as a shampoo or dental work on the occupant of the wheelchair. The invention comprises a base; a platform; a support frame attached between said base and platform; means attached between said base and said support frame for lifting said support frame; means attached between said support frame and said platform for tilting said platform; and means for securing a wheelchair and its occupant on said platform. An alternative embodiment of the invention comprises a housing, stationary means for supporting said housing; a wheelchair receptacle pivotally attached to said housing; means connected to said housing for selectively lifting or lowering said housing in a vertical direction; means connected to both said housing and said wheelchair receptacle for selectively tilting said wheelchair receptacle forward and backward; and means for securely attaching said wheelchair and said wheelchair patient to said wheelchair receptacle.

DETAILED DESCRIPTION OF THE INVENTION

The present invention is a lifting and tilting device for handling a wheelchair and its occupant so as to position the occupant for receiving a service such as a hair shampoo or dental work.

Figure 1:
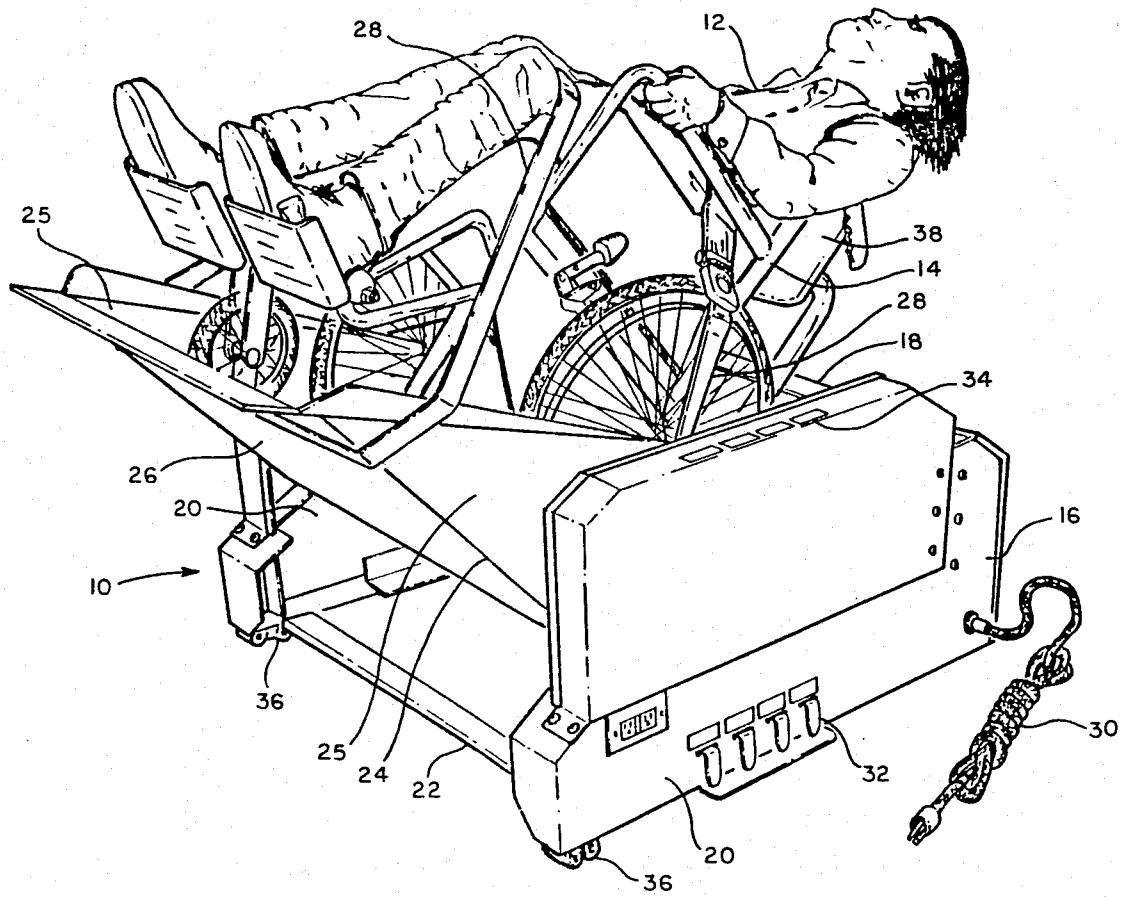
FIG. 1 is a perspective view of the wheelchair handling device with a person in a wheelchair after having been lifted and tilted.

Looking now at FIG. 1 the device is shown generally by numeral 10. As shown, a person 12 is sitting in a wheelchair 14 in a raised and tilted position such as would be convenient for receiving a service such as a hair shampoo or dental work. The device comprises a generally U-shaped base 16 having a rear closed portion 18, legs 20, and a cross plate 22 which provides support for the generally open forward end of the base. Mounted in the open portion of the base 16 is a platform 24 which comprises side members 25 connected at their lower edges by a floor 26. The wheelchair 14 and its occupant 12 are held firmly in place by safety belts 28 which pass along the platform sides 26 and over the wheelchair and its occupant.

The platform 24 is actuated by reversible electric motors through lift and tilt actuators all of which will be described in greater detail later in this description. Power is supplied to the motors through cord 30. Two sets of four switches 32 and 34 provide the means for supplying power to the electric motors for selectively raising, lowering, or tilting the platform 24. As will be noted the upper set of switches is adapted for hand operation while the lower set is adapted for foot actuation. The device is made portable by inclusion of rollers 36.

Figure 2:
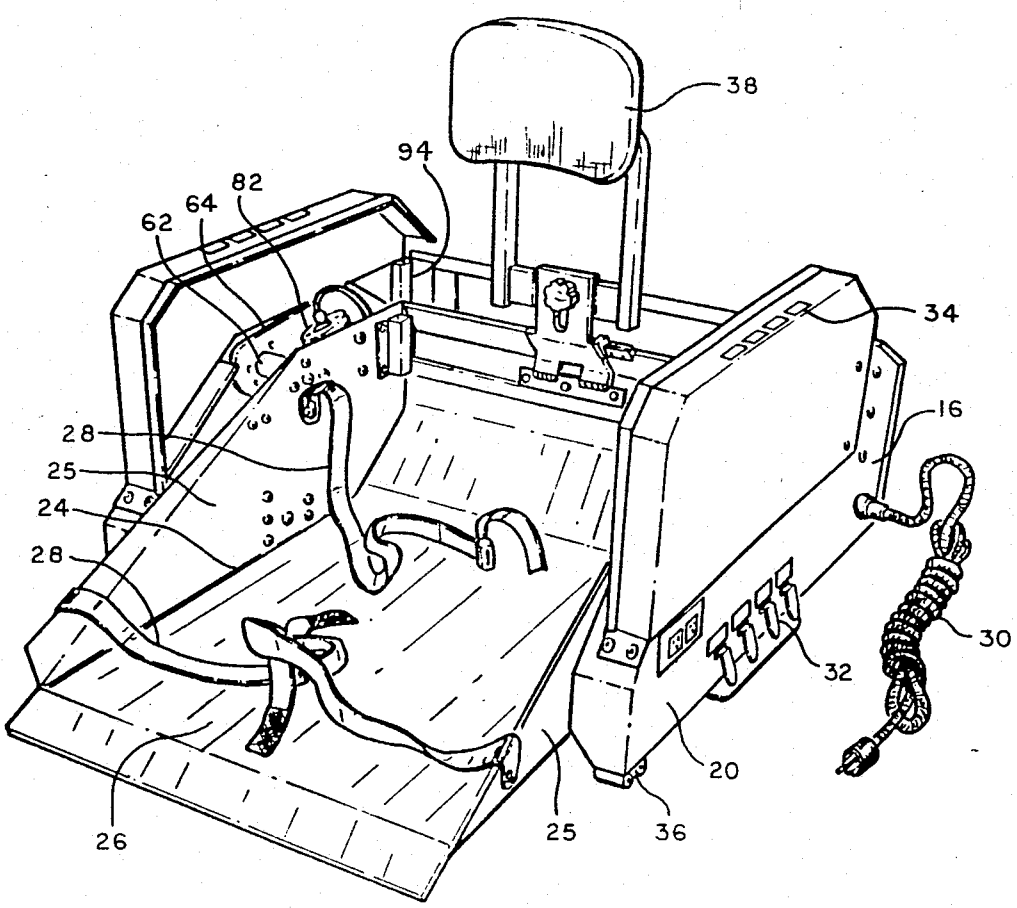
FIG. 2 is a perspective view of the wheelchair handling device in its lowered position.

As best illustrated in FIG. 2 the rear portion of platform 24 is provided with an adjustable backrest 38 which serves to support the wheelchair and its occupant when in the lifted and tilted position illustrated in FIG. 1. As is also illustrated in FIG. 2 the rear portion of the platform floor 26 is curved upwardly so as to support the wheels of the wheelchair 14 when the platform is in the raised and tilted position as illustrated in FIG. 1.

Figure 3:
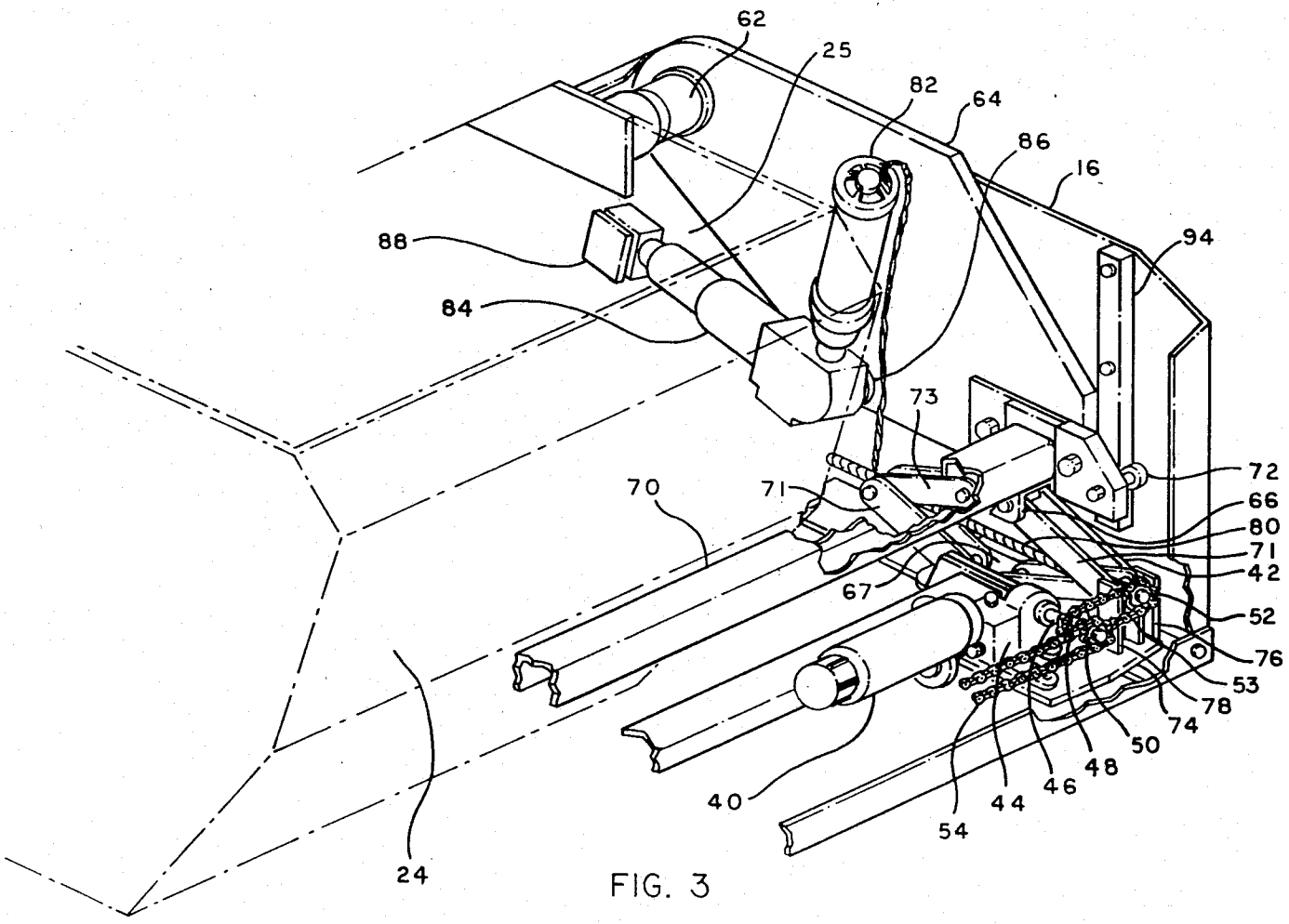
FIG. 3 is a fragmentary perspective view of the wheelchair handling device with portions broken away to more clearly illustrate the lifting and tilting mechanisms.
Figure 4:
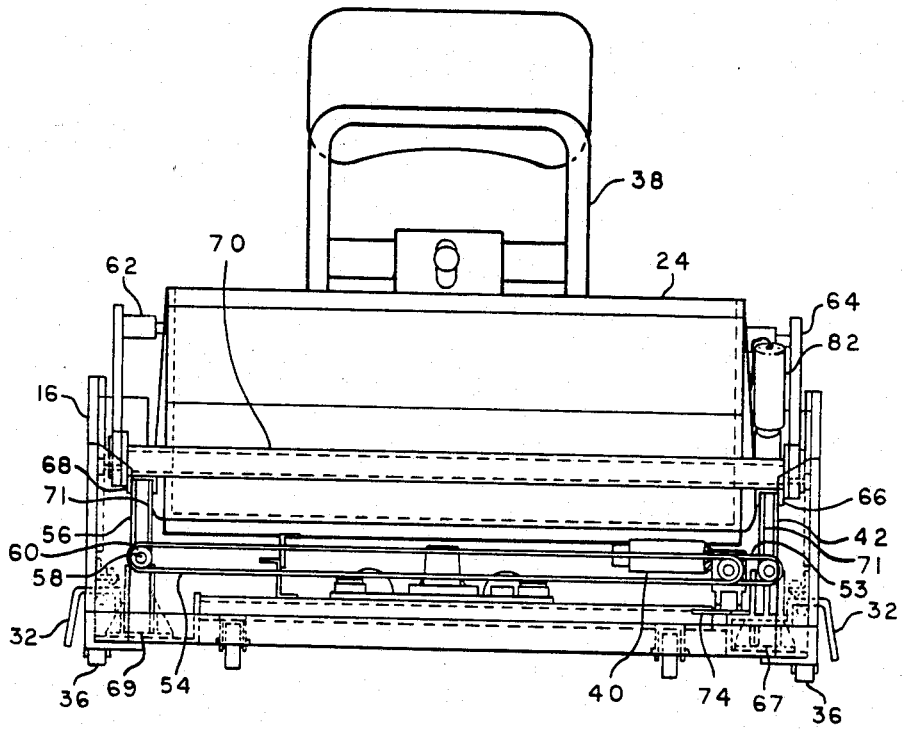
FIG. 4 is a rear view of the wheelchair handling device with portions thereof cut away to illustrate the operating mechanism of the device.
Figure 5:
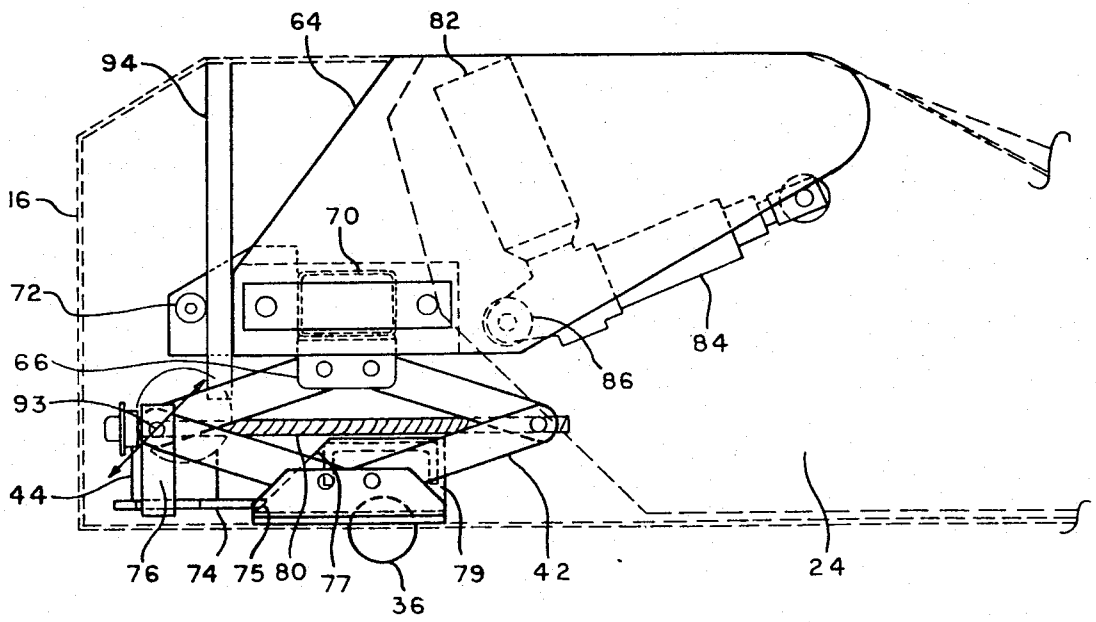
FIG. 5 is a fragmentary elevational view of the invention with portions broken away to more clearly illustrate the inner workings of the device.

The actuator mechanisms for lifting and tilting the platform 24 are best illustrated in FIGS. 3, 4, and 5 wherein portions of the device are shown in phantom and portions are broken away for clarity.

Referring now to FIGS. 3 and 4, a reversible motor 40 is utilized to operate a pair of scissors type lifting jacks 42 and 56 by transmitting driving power via transmission 44, shaft 46, sprockets 48, 50, 52, and 60, and chains 53 and 54. As best illustrated in FIG. 4, chain 54 transmits driving power to jack 56 through a sprocket 60 and a shaft 58. Thus it will be seen that the jacks 42 and 56 are actuated either up or down in unison by reversible motor 40.

As best illustrated in FIG. 3 the platform 24 is attached by a pivot connection 62 to a support frame 64 which in turn is attached to upper jack plates 66 and 68 of jacks 42 and 56 by support 70. The upper jack plates are connected to lower jack plates 67 and 69 by pairs of rearward and forward actuator arms 71 and 73. The support frame 64 is stabilized as it moves up and down by roller 72 and a slide (not shown), one on either side of a vertical bar 94. Thus it is seen that as the jacks 42 and 56 are actuated the support frame 64 and platform 24 may be raised or lowered in a generally vertical direction. As best illustrated in FIGS. 3 and 5 motor 40 and transmission 44 are mounted on a plate 74 which in turn is attached to pivot pin 93 on the aft end of jack 42 by means of vertical supports 76 and 78 and is thus free to move in a vertical direction as the screw shaft 80 is rotated and also moves in a vertical direction.

As best illustrated in FIG. 5 the forward edge 75 of mounting plate 74 is tapered to slideably interface with the tapered rear surface 77 of a vertical guide bar 79. Thus it will be seen that as the jacks are operated, for example, in an upward direction from the position illustrated in FIG. 5, the forward edge 75 of mounting plate 74 will follow the tapered rear surface 77 of guide bar 79 in an upward and forward direction. The angle of the surface 77 is a duplicate of the angle at which the pivot pin 93 moves in an upward and forward direction, as illustrated by the arrow extending in that direction from pin 93. Thus as the jack is operated the mounting plate 74 is constantly maintained in a position parallel to shaft 80. This relationship is necessary to maintain alignment of the driving chains and sprockets as the motor 40 and transmission 44 follow the movement of jack pin 93 when the jacks are actuated.

As illustrated in FIGS. 3 and 5 platform 24 is pivotally attached to support 64 by pivot connection 62. The tilting of platform 24 about pivot connection 62 is accomplished by operation of a reversible motor 82 which in turn lengthens and shortens a conventional actuator 84 which is connected to support frame 64 at its base end 86 and at its distal end 88 to side member 25 of platform 24.

The alternative embodiment 110 of the invention is shown in FIGS. 6–10. The wheelchair handling device 110 comprises a housing 102 which is capable of being raised or lowered by a lifting system 118 which will be described in detail later. Housing 102 rides on two wheels 108 at its front end and two casters 113 at its rear end. Within the housing 102 is a scoop-shaped wheelchair receptacle 104 which is pivotally attached (at pivot 156) to housing 102. Pivot 156 is held in position between housing 102 and wheelchair receptacle 104 by a pivot rod 111 which acts as an axle for pivot 156.

Receptacle 104 may be tilted forward or backward by tilting system 142. When tilted to its forward limit, the floor of receptacle 104 is level. At that point, ramp 109 on the front of receptacle 104 will just touch the room floor if housing 102 is at its lowest position. When receptacle 104 is tilted to its backward limit, the floor of receptacle 104 makes a 50 degree angle with the horizontal.

Housing 102 is supported by two, large, heavy scissors jacks 136, one jack being under each side of housing 102, each jack comprising two longitudinal members 137 and 139. Each pair of longitudinal members 137 and 139 are pivotally attached to each other at their centers at a pivot point 141, so that each jack 136 forms a flat letter "X" when viewed from the side. The lower ends of the two outside members 137 are located at the rear of housing 102. Lower crossbrace 138, which is pivotally attached to and runs between the two lower ends of the two members 137, also helps to support the rear end of housing 102. Pivots 147 are mounted between each end of crossbrace 138 and the corresponding lower end of one member 137. Mounted inboard from each end of crossbrace 138 is a caster 113. The upper ends of both members 137 are pivotally attached (at pivot 143, mounted in pivot support 145; see FIG. 8) to the inside of the front end of housing 102, one member 137 being attached to each side of housing 102.

The lower ends of the two inside members 139 each have an attached wheel 108. A front crossbrace 115 runs between the two lower ends of members 139. The upper ends of the two inside longitudinal members 139 are pivotally attached to opposite ends of upper crossbrace 130 (see FIG. 9) as will be explained in detail later.

Figure 6:
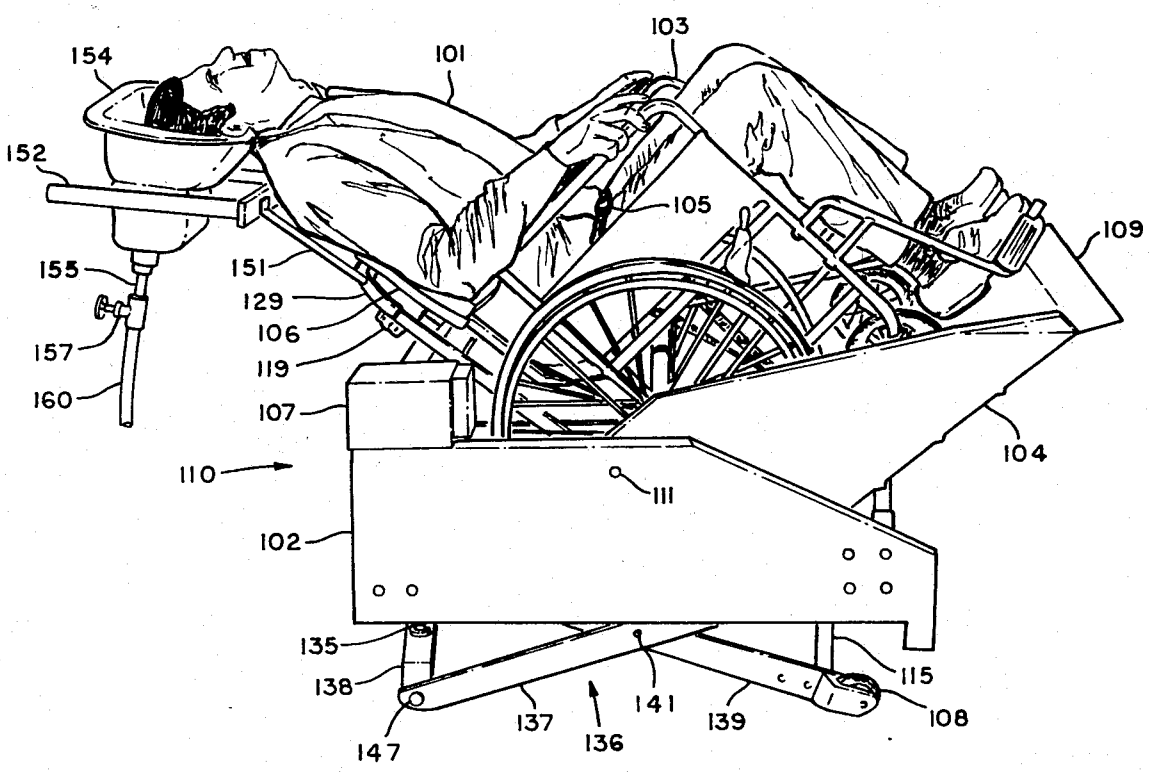
FIG. 6 is a side perspective view of an alternate (second) embodiment of the invention showing a wheelchair patient in a wheelchair attached to the invention, tilted backward in position to get a shampoo.
Figure 7:
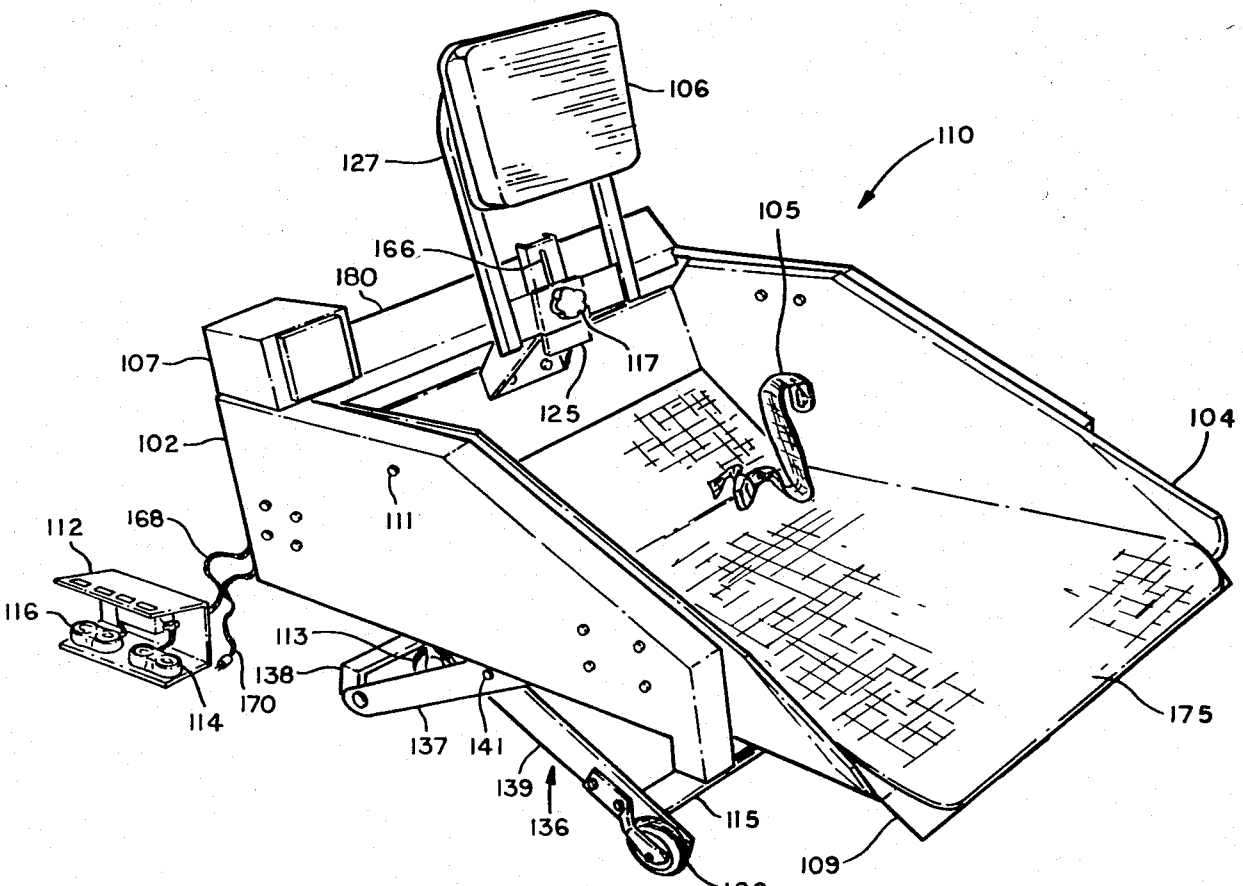
FIG. 7 is a perspective view of the second embodiment from the right front so that the wheelchair receptacle may be viewed.
Figure 8:
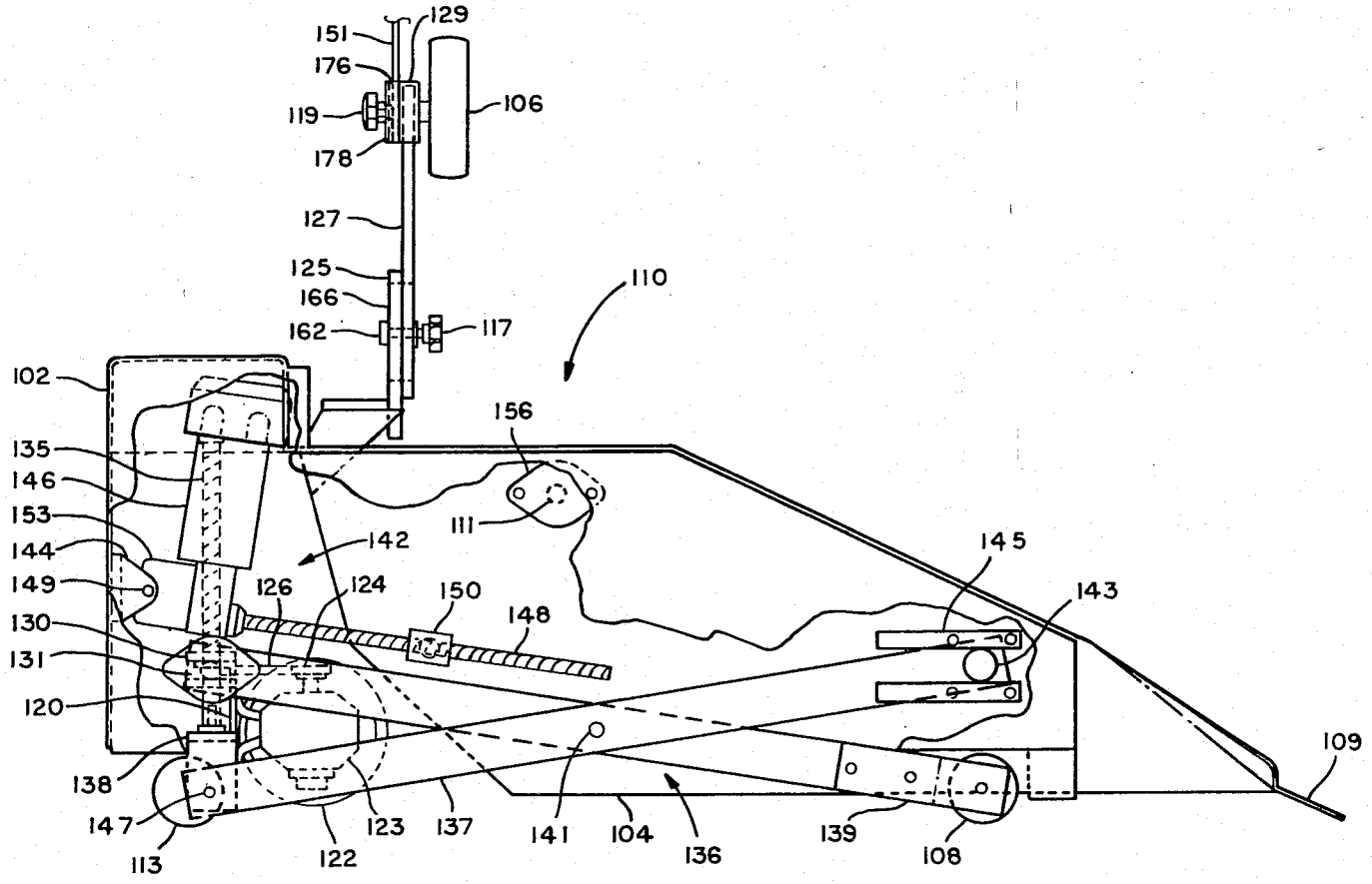
FIG. 8 is a side view of the second embodiment with portions of the housing cut away so that the lifting and tilting systems may be viewed.

Looking now at FIGS. 6, 7, and 8, a padded backrest 106 is adjustably attached to the back of wheelchair receptacle 104. The backrest 106 is mounted on a frame 127, which is configured so that it can slide up or down on a support bar 125 fixedly attached to receptacle 104. Backrest 106 may be secured in a desired position by tightening a wheelnut 117, attached to a bolt 162, which rides up and down in a vertical slot 166 in support bar 125.

A wash basin 154 may be used optionally with the invention 110. If the wash basin 154 is to be used, a metal hood 129 is slid down over the backrest frame 127. Attached to the back of hood 129 is a frame 178 containing slot 176, which is used to attach wash basin support 151 to hood 129 and thus to frame 127. Support 151 is a bar which can be slid into slot 176 and locked into position by tightening wheelnut 119. Firmly attached to support 151 is a U-shaped wash basin bracket 152, which supports the wash basin 154. Support 151 and bracket 152 are designed so that, when the wheelchair receptacle is tilted backward to its rear limit, the bracket 152 will be substantially level and thus will effectively support the wash basin 154. Wash basin 154 is equipped with a drain 155, a drain cut-off valve 157 and a drain hose 160.

Figure 9:
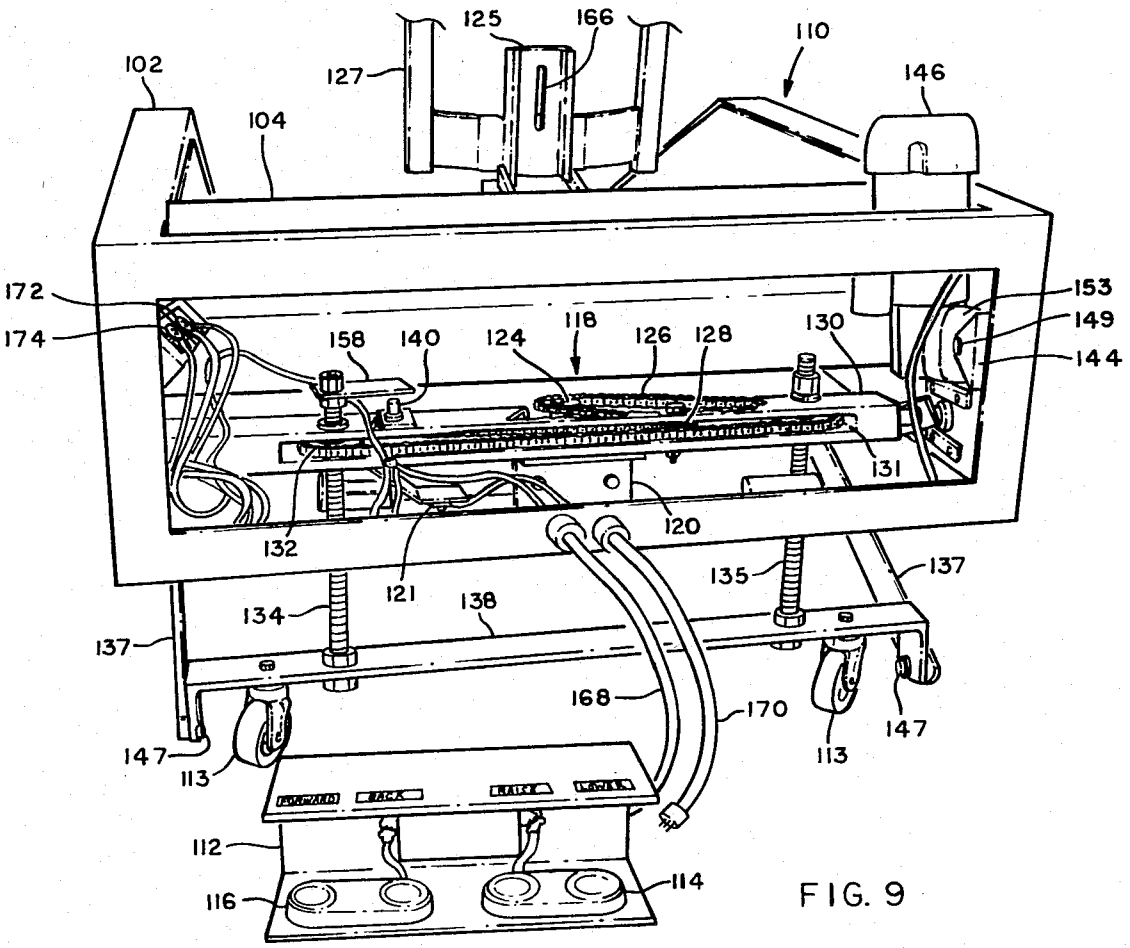
FIG. 9 is a perspective view of the second embodiment from the rear with the rear cover removed so that the lifting system may be viewed.
Figure 10:
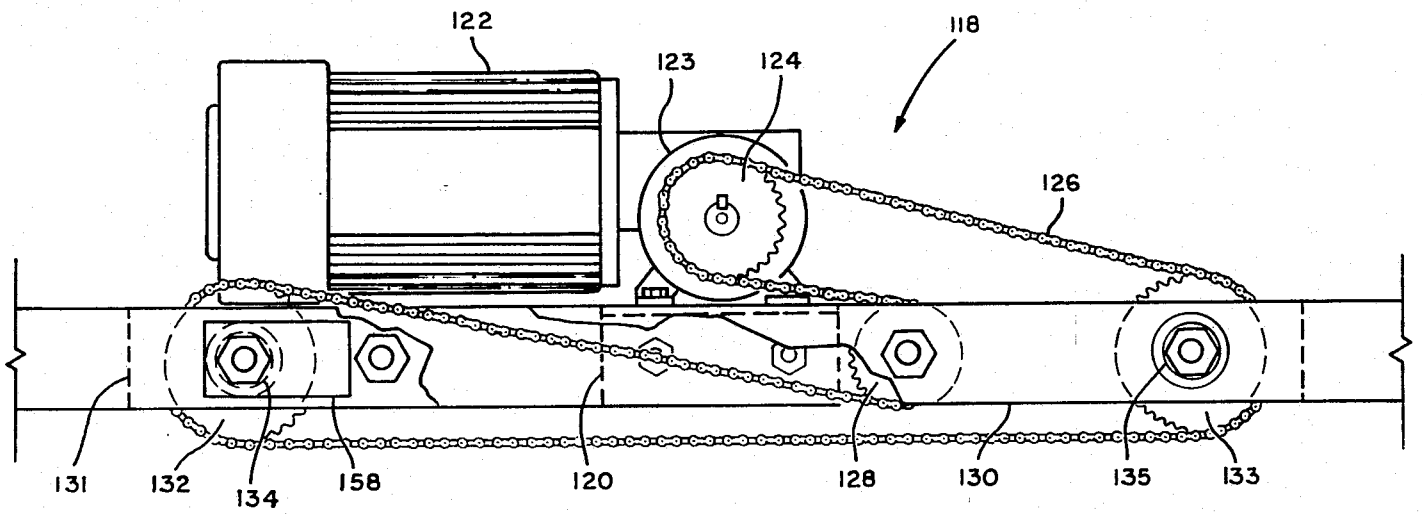
FIG. 10 is a top view of the chain drive for the lifting system with other parts cut away.

Looking now at FIG. 9 and 10, the lifting system 118 for wheelchair handling device 110 may be seen. Briefly, a reversible electric motor 122 drives a chain 126 which causes an upper crossbrace 130 to ride up and down on two vertical worm gears 134 and 135 and thus raise or lower the housing 102. More specifically, lifting system 118 comprises a motor mounting bracket 120, a reversible electric motor 122, a chain drive system comprising a chain 126, a chain drive sprocket 124, two driven worm gear threaded sprockets 132 and 133, an idler sprocket 128, two vertical worm gears 134 and 135 fixedly attached to lower crossbrace 138, and two scissors jacks 136 already described in detail earlier. Upper crossbrace 130 is a horizontal composite beam which actually comprises two flat longitudinal members spaced apart with a horizontal longitudinal slot 131 between them. Worm gear sprockets 132 and 133 and idler sprocket 128 are located within slot 131 and parts of chain 126 are located in slot 131, as may be seen in both FIGS. 9 and 10. The ends of upper crossbrace 130 are pivotally attached to both housing 102 and the upper ends of scissors jack members 139. FIG. 9 is shown with the rear cover removed in order that the lift system 118 may be seen. However, the device 110 is equipped with a rear cover 180 (see FIG. 7), having a flat back cover for housing 102 and having a raised motor hood portion 107 to cover the tilting motor 146.

Raising or lowering the invention 110 is accomplished by the lift system 118. Control box 112 is connected to the motor 122 through multi-conductor cable 168. Power cable 170 connects the device 110 to a 110 VAC source. Depressing the "RAISE" side of dual footpad 114 on the remote foot-operated control box 112 operates relay 172 which switches on the reversible electric motor 122. Motor 122 and its gearbox 123 are attached to upper crossbrace 130 by mounting bracket 120. The motor 122 turns a chain drive sprocket 124 which turns the chain 126 in a counter-clockwise direction. An idler sprocket 128 keeps the chain 126 safely clear of the electric motor 122. The chain 126 turns two worm gear driving sprockets 132 and 133 which are center threaded so that each one mates with its corresponding vertical worm gear, 134 and 135, respectively. As sprockets 132 and 133 turn, they ride up on the vertical worm gears 134 and 135, respectively, which are fixedly attached at their lower ends to lower crossbrace 138, which is itself stationary. As sprockets 132 and 133 ride upward on the worm gears 134 and 135, they also carry both upper crossbrace 130 and the upper ends of scissors jack members 139 upward. Since the ends of upper crossbrace 130 and the upper ends of scissors jack members 139 are all pivotally attached to the housing 102, the housing 102 is therefore also moved upward. This action continues until the "RAISE" side of the footpad switch 114 is released or until upper limit cut-off switch 140, which is mounted on top of upper crossbrace 130, comes into contact with upper limit switch plate 158, which is mounted on the top of worm gear 134. To lower the housing 102, one would depress the "LOWER" side of dual footpad switch 114, causing the motor 122 to spin in the opposite direction. In this case, the housing would continue to move downward until the footpad switch 114 is released or until lower limit contact switch 121, mounted on housing 102, comes into contact with lower crossbrace 138.

Looking now at FIG. 8, the tilting system 142 tilts the wheelchair receptacle forward or backward. The tilting system comprises a motor mounting bracket 144 fixedly attached to the back of housing 102, a reversible electric motor 146 and gear box, both pivotally attached to bracket 144 at pivot point 149, a worm gear 148 fixedly attached to gear box 153, and a worm gear follower 150 pivotally attached to wheelchair receptacle 104. The tilting system 142 tilts the wheelchair receptacle 104 from the horizontal lower limit backwards to an upper limit of about 50 degrees with the horizontal. These upper and lower limit motor cut-off points are preset into the motor 146 in accordance with its design capabilities, so that motor 146 cuts itself off at these points in a manner already known to those skilled in the art.

To tilt the wheelchair receptacle backward, one presses the "BACK" side of the dual footpad switch 116. This operates relay 174 which turns on reversible electric motor 146. Motor 146 and its gear box 153 are pivotally attached (at pivot point 149) to motor mounting bracket 144, which in turn is fixedly attached to housing 102. Electric motor 146 drives worm gear 148 in a clockwise motion. As worm gear 148 turns, worm gear follower 150 travels along the worm gear 148 toward the front of the wheelchair receptacle 104. Wheelchair receptacle thus is caused to tilt backwards, rotating about pivot point 111 of swivel joint 156, which attaches the wheelchair receptacle 104 to the housing 102. This action continues until the "BACK" portion of footpad switch 116 is released or until the limit switches in the motor 146 cause the motor to cut off. To tilt the wheelchair receptacle 104 forward, the "FORWARD" portion of the dual footpad switch 116 is depressed, thus causing motor 146 to run in the opposite direction. The receptacle 104 continues to tilt forward until the footpad switch 116 is released or until motor 146 cuts itself off automatically at its lower limit position.

To operate the wheelchair handling device 10 and referring now to FIGS. 1, 3, and 4, after having securely placed the wheelchair 14 and its occupant 12 on the platform 24, an operator of the device would lift the platform to a desired height by operation of the appropriately labeled switch from either switch set 32 or 34. Operation of the appropriate lift switch would actuate motor 40 which through its drive mechanism will cause the jacks 42 and 56 to raise the support frame 64 and platform 24. Either during the lifting operation, or after, the platform may be tilted by operating the appropriately labeled tilt switch in either switch set 32 or 34. Operation of either a forward or rearward tilt switch will start motor 82 which causes actuator 84 to lengthen or shorten as desired thus tilting platform 24, the wheelchair, and its occupant to the desired position.

To operate wheelchair handling device 110, shown in FIGS. 6–10, dual footpad switch 116 is used to tilt wheelchair receptacle 104 forward until it reaches its forward limit. Then dual footpad switch 114 is used to lower the housing 102 until wheelchair receptacle ramp 109 just touches the floor of the room. Wheelchair 103 with a patient 101 in it is then pushed backward into the wheelchair receptacle 104. Seatbelt 105 is fastened in order to secure both the wheelchair 103 and the patient 101 to wheelchair receptacle 104. Housing 102 is then raised to the desired height by the use of the "RAISE" portion of dual footpad switch 114. The metal hood 129 is then put in position over the top of backrest frame 127. Wash basin support 151 is then inserted in slot 176 in frame 178. Wheelnut 119 is then tightened to secure wash basin support 151 and its permanently attached bracket 152 firmly in position. The "BACK" portion of dual footpad switch 116 is then used to tilt wheelchair receptacle 104 backward to the point where wash basin support bracket 152 is substantially level. Wash basin 154 is then placed upon bracket 152 so that wash basin 154, together with its attached drain 155, drain valve 157, and drain hose 160 are all supported by bracket 152. The wheelchair handling device 110 and its above-mentioned equipment are now all ready to give the patient 101 a shampoo.

I claim:

1. A device for handling a wheelchair and a patient in said wheelchair comprising:

a housing;

stationary means for supporting said housing;

a wheelchair receptacle pivotally attached to said housing;

means connected to said housing for selectively lifting or lowering said housing in a vertical direction, said means comprising:

vertically moveable support means pivotally attached to said housing;

jack means pivotally attached to both said housing and to said vertically moveable support means;

a reversible electric motor attached to said vertically moveable support means;

two stationary vertical worm gears attached to said stationary means for supporting said housing; and a chain drive connected to said motor and attached to said vertically moveable support means, said chain drive comprising a chain and two driven sprockets, said driven sprockets being center-threaded to mate with said worm gears;

means connected to both said housing and said wheelchair receptacle for selectively tilting said wheelchair receptacle forward and backward; and means for securely attaching said wheelchair and said wheelchair patient to said wheelchair receptacle;

whereby said electric motor may operate said chain drive, thus causing said driven sprockets to travel up said vertical worm gears thus causing said vertically moveable support means to move upward, also raising said jacks and raising said housing.

2. The device of claim 1 wherein said vertically moveable support means is an upper crossbrace which comprises two horizontal beams spaced apart with a slot between them and said chain drive is partially contained within said slot.

3. The device of claim 2 comprising a gear box for said motor and wherein said motor and gear box are offset from said upper crossbrace and are attached to said upper crossbrace by a motor mounting bracket.

4. The device of claim 3 wherein said motor and gear box are connected to a driving sprocket which is offset from said upper crossbrace.

5. The device of claim 4 wherein said two driven sprockets are centered on the width of said upper crossbrace and are located within said slot in said upper crossbrace.

6. The device of claim 5 wherein said chain drive comprises an idler sprocket for keeping said chain safely clear of said electric motor.

7. The device of claim 6 wherein said stationary means for supporting said housing is a horizontal lower crossbrace and said two vertical worm gears are both fixedly attached to said lower crossbrace and extend upward therefrom.

8. The device of claim 7 wherein said means for selectively tilting said wheelchair receptacle comprises:

a second reversible electric motor and attached gear box pivotally attached to the rear of said housing;

a worm gear fixedly attached to said gear box; and a worm gear follower arranged to travel along said worm gear, said worm gear follower being pivotally attached to said wheelchair receptacle;

whereby said motor turns said worm gear and said follower travels along said worm gear, thus causing said wheelchair receptacle to pivot forwards or backwards.

9. The device of claim 8 comprising a control box connected to both said reversible motors, said control box comprising two dual footpad switches, one of said switches being arranged to selectively raise and lower said housing and the other said dual footpad switch being arranged to selectively tilt said wheelchair receptacle forward or backward.

10. A device for lifting and tilting a wheelchair and a patient in said wheelchair comprising:

an elongated housing having a front end and a rear end;

means for supporting said housing;

a wheelchair receptacle pivotally attached to said housing;

means connected to said housing for selectively lifting or lowering said housing in a vertical direction, said lifting means comprising:

vertically moveable support means pivotally attached to said rear end of said housing;

means connected to both said vertically moveable support means and said supporting means for raising or lowering said vertically moveable support means; and jack means pivotally attached to both the front end of said housing and to said vertically moveable support means;

means connected to both said housing and said wheelchair receptacle for selectively tilting said wheelchair receptacle backward and forward; and means for securely attaching said wheelchair and said wheelchair patient to said wheelchair receptacle;

whereby said lifting or lowering means may be operated to raise said rear end of said housing thus also raising said jack means and in turn causing said jack means to also raise said front end of said housing.

11. The device for lifting and tilting a wheelchair as set forth in claim 10 wherein said means for lifting or lowering said vertically moveable support means is an electro-mechanical mechanism.

12. A device for lifting and tilting a wheelchair and a patient in said wheelchair comprising:

an elongated housing, said housing having a front end and a rear end;

means for supporting said housing;

a wheelchair receptacle pivotally attached to said housing;

means connected to said rear end of said housing for selectively lifting or lowering said rear end of said housing in a vertical direction;

jack means pivotally attached to said supporting means, said lifting means and said front end of said housing so that when said lifting means raises the said rear end of said housing, it also raises said jack means which in turn raises the said front end of said housing;

means connected to both said housing and said wheelchair receptacle for selectively tilting said wheelchair receptacle forward and backward; and means for securely attaching said wheelchair and said wheelchair patient to said wheelchair receptacle.

13. The device for lifting or lowering a wheelchair as set forth in claim 12 wherein said lifting means is an electro-mechanical mechanism.

* * * * *